US012660857B2

(12) United States Patent
Lee et al.

(10) Patent No.: US 12,660,857 B2
(45) Date of Patent: Jun. 23, 2026

(54) AEROSOL GENERATING DEVICE AND OPERATION METHOD THEREOF

(71) Applicant: KT&G CORPORATION, Daejeon (KR)

(72) Inventors: Won Kyeong Lee, Gyeonggi-do (KR); Min Kyu Kim, Daejeon (KR); Jong Sub Lee, Gyeonggi-do (KR); Byung Sung Cho, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 502 days.

(21) Appl. No.: 17/624,683

(22) PCT Filed: Dec. 22, 2020

(86) PCT No.: PCT/KR2020/018885
§ 371 (c)(1),
(2) Date: Jan. 4, 2022

(87) PCT Pub. No.: WO2021/162236
PCT Pub. Date: Aug. 19, 2021

(65) Prior Publication Data

US 2022/0273042 A1 Sep. 1, 2022

(30) Foreign Application Priority Data

Feb. 11, 2020 (KR) ..... 10-2020-0016631

(51) Int. Cl.
*A24F 40/51* (2020.01)
*A24F 40/57* (2020.01)

(52) U.S. Cl.
CPC ..... *A24F 40/51* (2020.01); *A24F 40/57* (2020.01)

(58) Field of Classification Search
None
See application file for complete search history.

(56) References Cited

U.S. PATENT DOCUMENTS 9,532,600 B2 1/2017 Thorens et al.
10,448,670 B2 10/2019 Talon et al.
(Continued)

FOREIGN PATENT DOCUMENTS

CN 103237468 A 8/2013
CN 109965355 A 7/2019
(Continued)

OTHER PUBLICATIONS

Extended European Search Report dated Jul. 29, 2022 in European Application No. 20918326.8.
(Continued)

*Primary Examiner* — Philip Y Louie
*Assistant Examiner* — Jeffrey A. Buckman
(74) *Attorney, Agent, or Firm* — Sughrue Mion, PLLC

(57) ABSTRACT

An aerosol generating device including: a heater configured to heat an aerosol-generating material; a battery configured to supply power to the heater; an airflow detecting sensor configured to detect a change in airflow inside the aerosol generating device; a pressure sensor configured to detect a pressure change outside the aerosol generating device; and a controller, wherein the controller may determine whether a puff has occurred based on a first sensing value received from the air flow detection sensor and a second sensing value received from the pressure sensor.

6 Claims, 6 Drawing Sheets

(56) References Cited

U.S. PATENT DOCUMENTS

| | | | |
|---|---|---|---|
| 10,842,195 | B2 | 11/2020 | Adair |
| 2013/0340750 | A1 | 12/2013 | Thorens et al. |
| 2017/0079329 | A1 | 3/2017 | Zitzke |
| 2018/0146710 | A1* | 5/2018 | Bessant ..... H05B 1/0227 |
| 2018/0292250 | A1 | 10/2018 | Colotte et al. |
| 2019/0159519 | A1 | 5/2019 | Bowen et al. |
| 2019/0246701 | A1 | 8/2019 | Nakano et al. |
| 2019/0246703 | A1 | 8/2019 | Nakano et al. |
| 2019/0364969 | A1 | 12/2019 | Fu et al. |
| 2024/0081401 | A1 | 3/2024 | Bowen et al. |

FOREIGN PATENT DOCUMENTS

| | | | |
|---|---|---|---|
| CN | 110418582 | A | 11/2019 |
| EP | 3 488 715 | A2 | 5/2019 |
| JP | 2013-545474 | A | 12/2013 |
| KR | 10-2017-0076703 | A | 7/2017 |
| KR | 10-2019-0038181 | A | 4/2019 |
| KR | 10-2019-0060708 | A | 6/2019 |
| WO | 2019/104277 | A1 | 5/2019 |

OTHER PUBLICATIONS

Notification of Reasons for Refusal dated Mar. 14, 2023 from the Japanese Patent Office in application No. 2022-508952.

Korea Intellectual Property Office Notification of Reason for Refusal for KR10-2020-0016631 dated May 24, 2021.

International Search Report of PCT/KR2020/018885 dated Apr. 7, 2021 [PCT/ISA/210].

Written Opinion of PCT/KR2020/018885 dated Apr. 7, 2021 [PCT/ISA/237].

Office Action issued Mar. 26, 2025 in Chinese Patent Application No. 202080072754.1.

Chinese Office Action dated Jan. 12, 2026, issued in Chinese application No. 202080072754.1.

* cited by examiner

[Fig. 1]
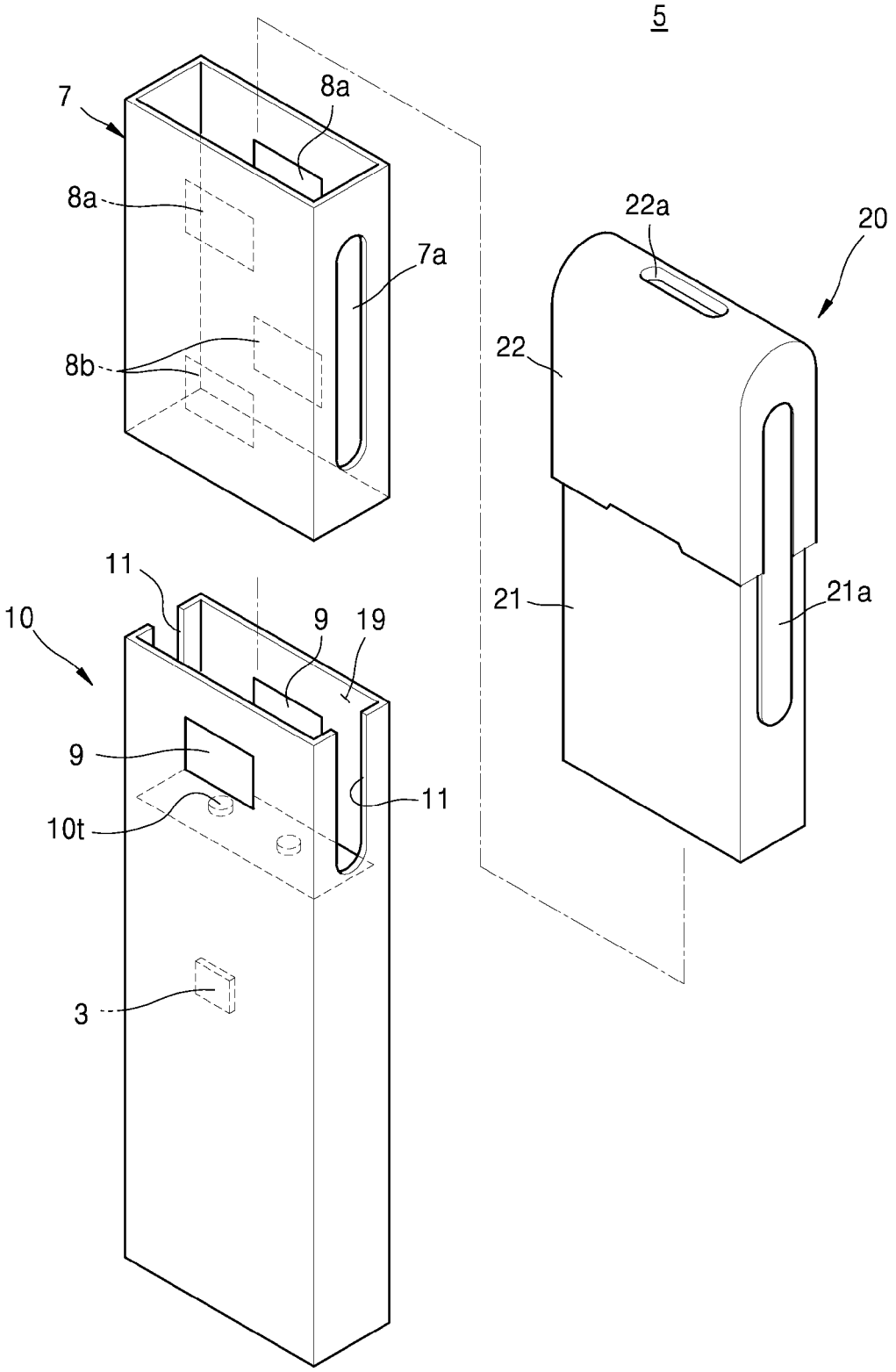

[Fig. 2]
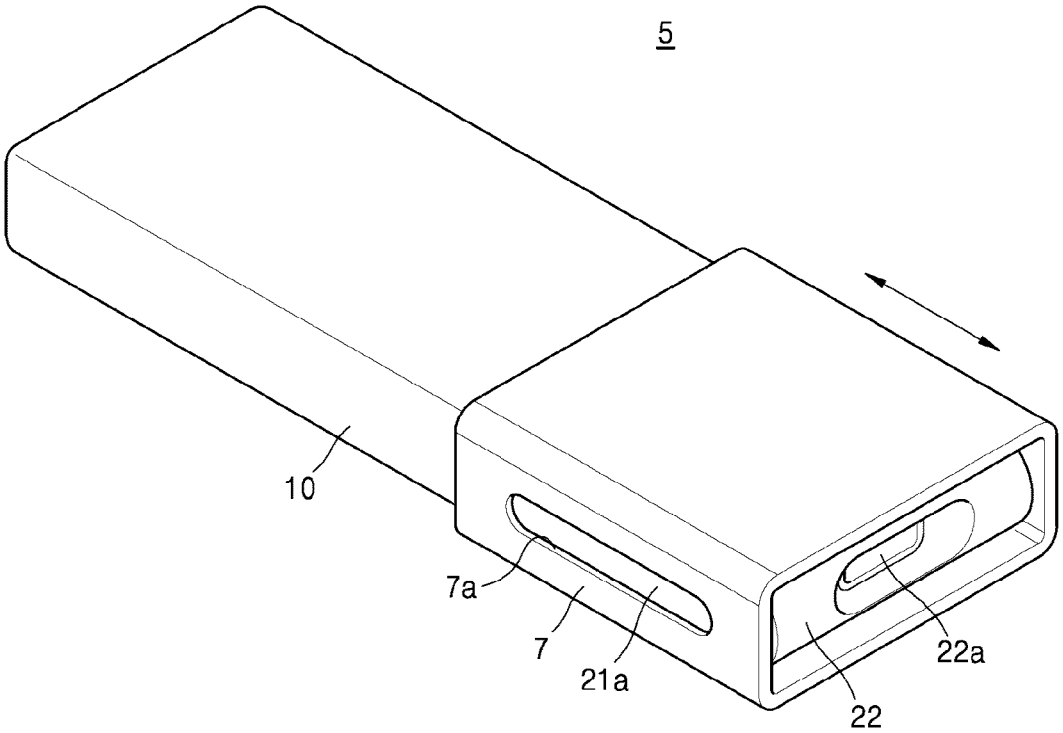
[Fig. 3]
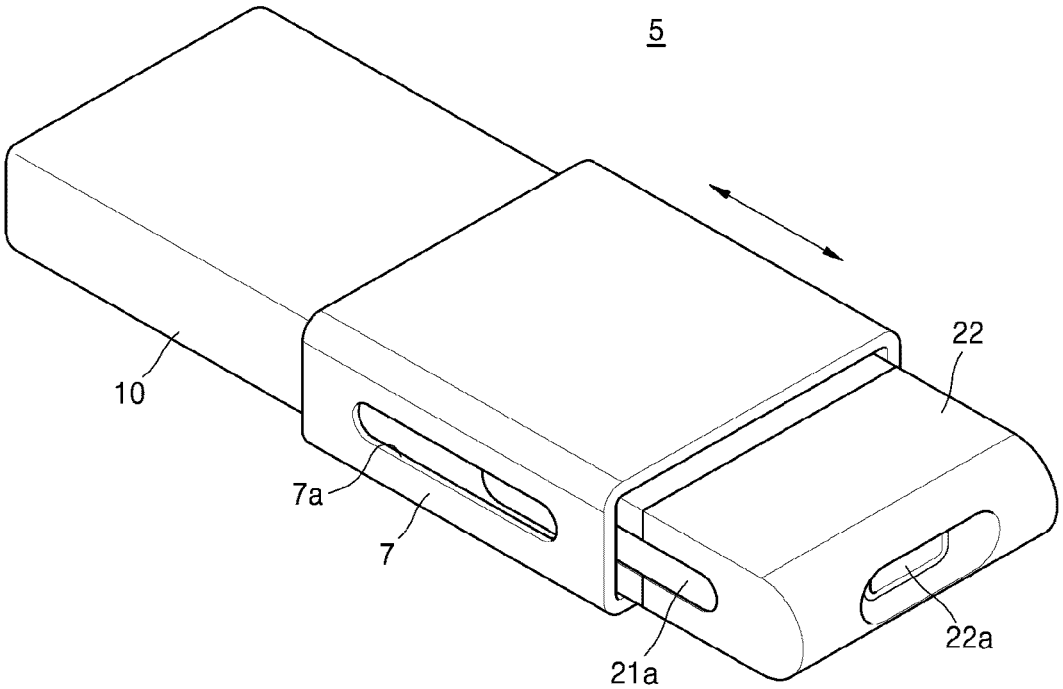

[Fig. 4]
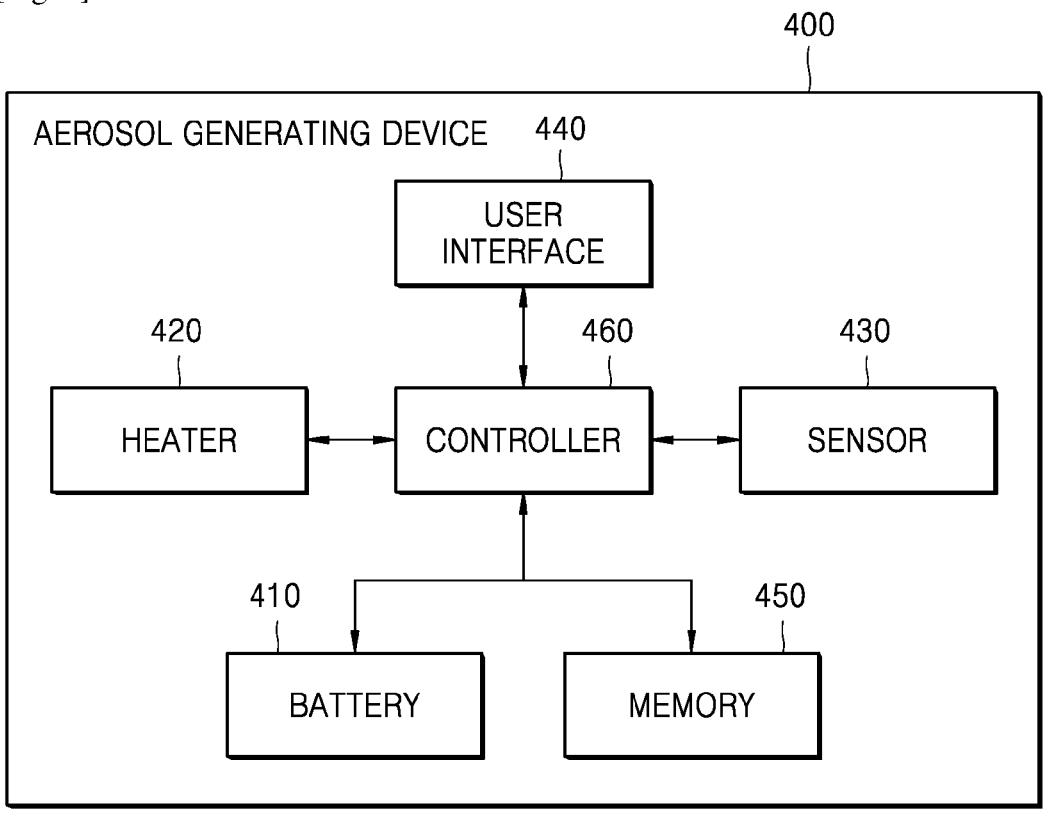
[Fig. 5]
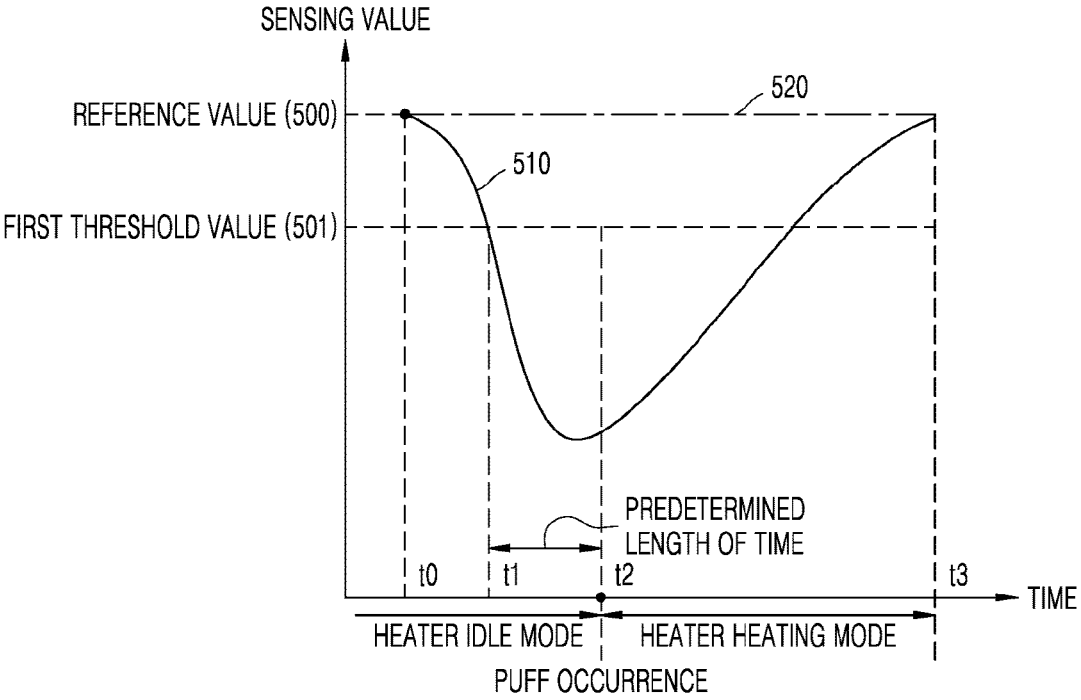

[Fig. 6]
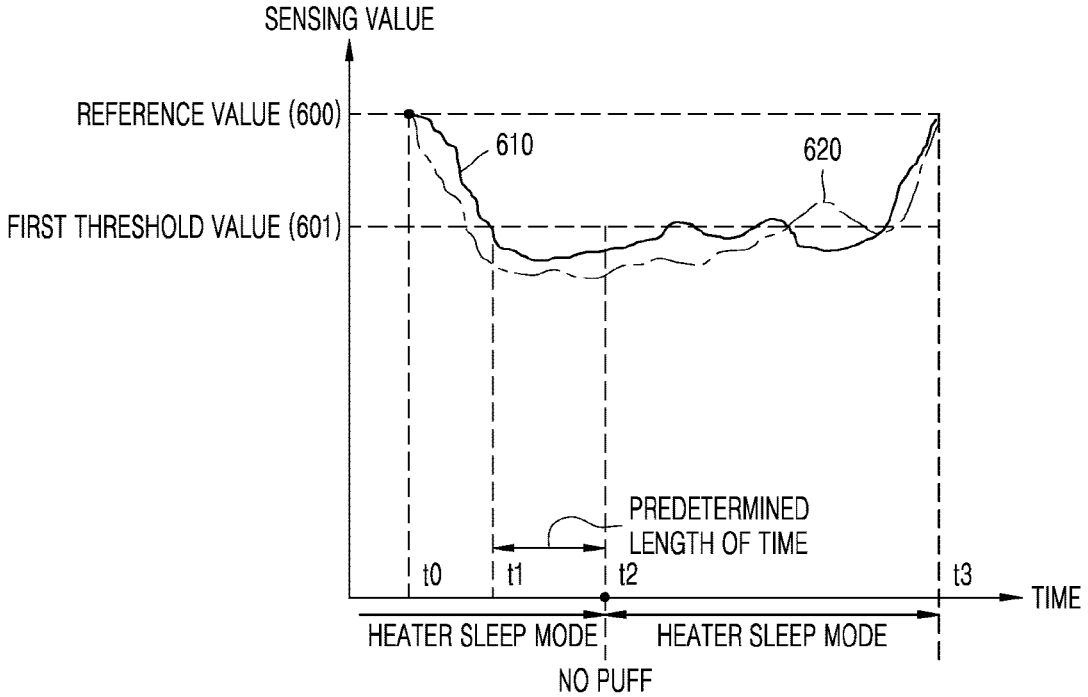
[Fig. 7]
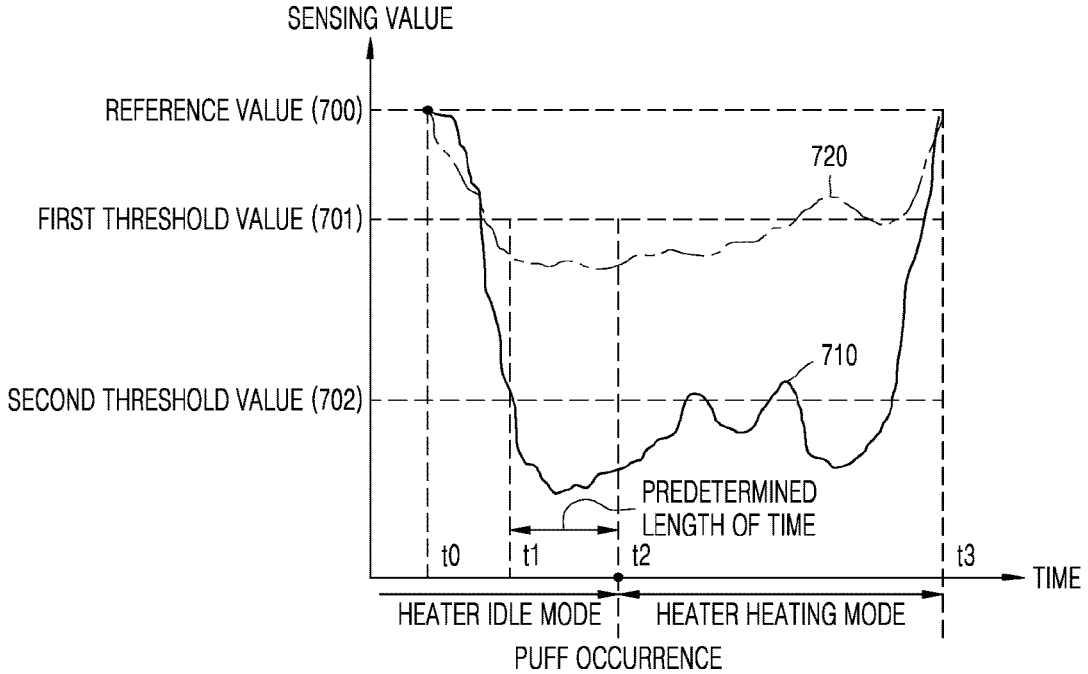

[Fig. 8]
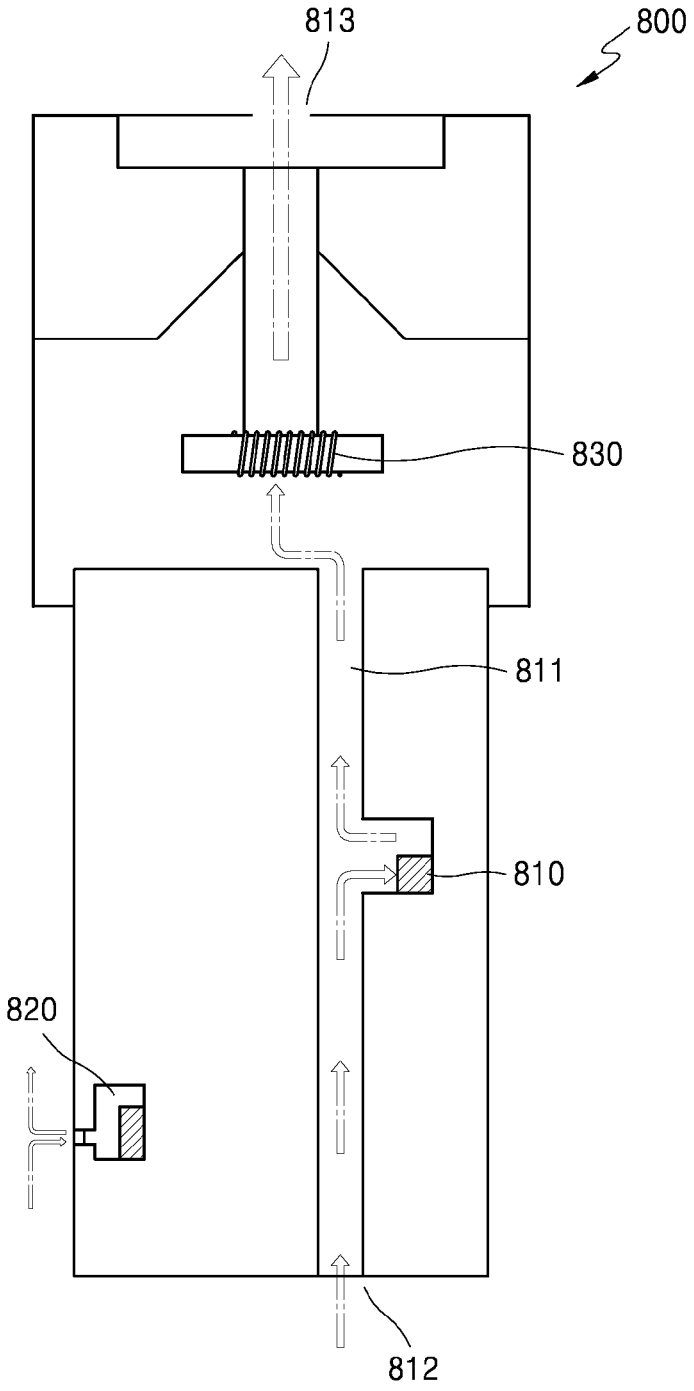

[Fig. 9]
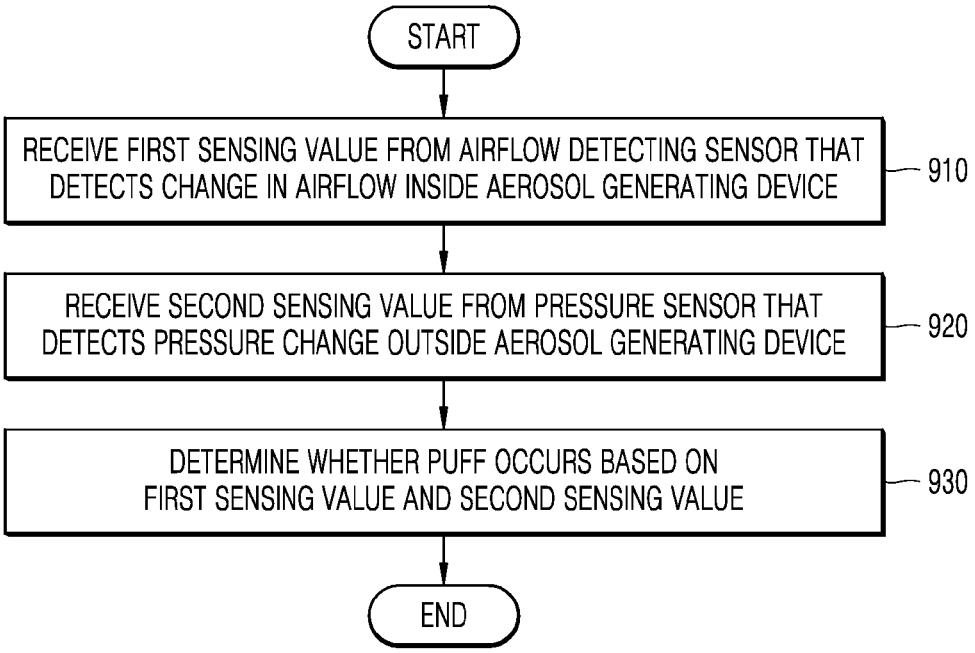

AEROSOL GENERATING DEVICE AND OPERATION METHOD THEREOF

CROSS REFERENCE TO RELATED APPLICATIONS

This application is a National Stage of International Application No. PCT/KR2020/018885 filed on Dec. 22, 2020, claiming priority based on Korean Patent Application No. 10-2020-0016631 filed on Feb. 11, 2020.

TECHNICAL FIELD

The present disclosure relates to an aerosol generating device and an operation method thereof.

BACKGROUND ART

Recently, there has been increasing demand for an alternative to traditional cigarettes. For example, many people use an aerosol generating device that generates an aerosol by heating an aerosol generating material, instead of smoking combustive cigarettes.

A puff detecting sensor of an aerosol generating device detects a change in pressure, and a controller controls a heater based on the change in pressure. On the other hand, when the pressure outside the aerosol generating device changes rapidly, the puff detecting sensor may also detect the change in pressure. In this case, the controller may erroneously determine that a puff has occurred even if a puff has not actually occurred.

DISCLOSURE

Technical Problem

One or more embodiments provide an aerosol generating device and an operation method thereof. In addition, one or more embodiments provide a device and a method capable of accurately detecting a puff by considering a pressure change outside the aerosol generating device. Furthermore, one or more embodiments include a non-transitory computer-readable recording medium having recorded thereon a program for executing the method.

Additional aspects will be set forth in part in the description which follows and, in part, will be apparent from the description, or may be learned by practice of the presented embodiments.

Technical Solution

As a technical device for achieving the above-mentioned technical problem, the first aspect of the present disclosure may provide an aerosol generating device including: a heater configured to heat an aerosol generating material; a battery configured to supply power to the heater; an airflow detecting sensor configured to detect a change in airflow inside the aerosol generating device; a pressure sensor configured to detect a pressure change outside the aerosol generating device; and a controller, wherein the controller determines whether a puff has occurred based on a first sensing value received from the airflow detecting sensor and a second sensing value received from the pressure sensor.

The second aspect of the present disclosure may provide a method of controlling an aerosol generating device including: receiving a first sensing value from an airflow detecting sensor that detects a change in airflow inside the aerosol generating device; receiving a second sensing value from a pressure sensor that detects a pressure change outside the aerosol generating device; and determining whether a puff has occurred based on the first sensing value and the second sensing value.

The third aspect of the present disclosure may provide a computer-readable recording medium having recorded thereon a program for executing the method of the second aspect.

Advantageous Effects

According to one or more embodiments, by determining whether a puff has occurred using an airflow detecting sensor and a pressure sensor, false detection of a puff due to a rapid change of outside pressure may be prevented.

In addition, according to one or more embodiments, when an actual puff has not occurred but the pressure outside an aerosol generating device changes rapidly, power is prevented from being supplied to a heater, thereby preventing energy loss and reducing a fire risk.

In addition, according to one or more embodiments, by determining whether a puff has occurred using an airflow detecting sensor and a pressure sensor, it is possible to accurately detect a puff even when the pressure outside an aerosol generating device changes.

DESCRIPTION OF DRAWINGS

FIG. 1 is an exploded perspective view schematically illustrating a coupling relationship between a replaceable cartridge containing an aerosol generating material and an aerosol generating device including the same, according to an embodiment.

FIG. 2 is a perspective view of an exemplary operating state of the aerosol generating device according to the embodiment illustrated in FIG. 1.

FIG. 3 is a perspective view of another exemplary operating state of the aerosol generating device according to the embodiment illustrated in FIG. 1.

FIG. 4 is a block diagram illustrating hardware components of the aerosol generating device according to an embodiment.

FIG. 5 is an exemplary graph showing a change in a sensing value of a pressure sensor over time when a puff occurs while outside pressure does not change, according to an embodiment.

FIG. 6 is an exemplary graph showing a change in a sensing value of a pressure sensor over time when outside pressure changes while there is no puff, according to an embodiment.

FIG. 7 is an exemplary graph showing a change in a sensing value of a pressure sensor over time when a puff occurs and pressure outside an aerosol generating device changes, according to an embodiment.

FIG. 8 is a cross-sectional view of an aerosol generating device including a plurality of pressure sensors, according to an embodiment.

FIG. 9 is a flowchart illustrating a method of controlling an aerosol generating device according to an embodiment.

MODE FOR INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, a "puff" refers to a user's act of smoking on an aerosol generating device (i.e., inhaling from the aerosol generating device).

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes a cartridge 20 containing the aerosol generating material and a main body 10 supporting the cartridge 20.

The cartridge 20 containing the aerosol generating material may be coupled to the main body 10. A portion of the cartridge 20 is inserted into an accommodation space 19 of the main body 10 so that the cartridge 20 may be mounted on the main body 10.

The cartridge 20 may contain an aerosol generating material in any one of, for example, a liquid state, a solid state, a gaseous state, or a gel state. The aerosol generating material may include a liquid composition. For example, the liquid composition may be a liquid including a tobacco-containing material, a liquid having a volatile tobacco flavor component, and or a liquid including a non-tobacco material.

For example, the liquid composition may include one component of water, solvents, ethanol, plant extracts, spices, flavorings, and vitamin mixtures, or a mixture thereof. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight relative to the total solution weight of the liquid composition such that a proper nicotine concentration is obtained.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating an aerosol by converting the phase of the aerosol generating material inside the cartridge 20 to a gaseous phase. The aerosol may refer to a gas in which vaporized particles generated from an aerosol generating material are mixed with air.

For example, the cartridge 20 may convert the phase of the aerosol generating material by receiving the electrical signal from the main body 10 and heating the aerosol generating material, or by using an ultrasonic vibration method, or by using an induction heating method. As another example, when the cartridge 20 includes its own power source, the cartridge 20 may generate aerosol by being operated by an electric control signal or a wireless signal transmitted from the main body 10 to the cartridge 20.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element including (e.g., impregnated with) an aerosol generating material, such as a sponge, cotton, fabric, or porous ceramic structure.

The atomizer may include, for example, a liquid delivery element (e.g., wick) for absorbing the aerosol generating material and maintaining the same in an optimal state for conversion to the aerosol, and a heater heating the liquid delivery element to generate the aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like. And it may be implemented by a conductive filament using a material such as a nichrome wire, wound on the liquid delivery element, or arranged adjacent to the liquid delivery element, by.

In addition, the atomizer may be implemented by a heating element in the form of a mesh or plate, which performs both the functions of absorbing the aerosol generating material and maintaining the same in an optimal state for conversion to aerosol without using a separate liquid delivery element and the function of generating aerosol by heating the aerosol generating material.

At least a portion of the liquid storage 21 of the cartridge 20 may include a transparent material so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and the liquid storage 21 may be entirely formed of transparent plastic or glass. Alternatively, only the protruding window 21*a* corresponding to a portion of the liquid storage 21 may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 through the connection terminal 10*t* or supply a signal related to operation of the cartridge 20 to the cartridge 20.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 to be movable with respect to the main body 10. The slider 7 covers at least a portion of the mouthpiece 22 of the cartridge 20 coupled to the main body 10 or exposes at least a portion of the mouthpiece 22 to the outside by moving with respect to the main body 10. The slider 7 includes an elongated hole 7*a* exposing at least a portion of the protruding window 21*a* of the cartridge 20 to the outside.

The slider 7 has a container shape including a hollow space opened to both ends. The structure of the slider 7 is not limited to the container shape as shown in the drawings, and the slider 7 may have a bent plate structure having a clip-shaped cross-section, which is movable with respect to the main body 10 while being coupled to an edge of the main body 10, or a structure having a curved semi-cylindrical shape with a curved arc-shaped cross section.

The slider 7 may include a magnetic body for maintaining the position of the slider 7 with respect to the main body 10 and the cartridge 20. The magnetic body may include a permanent magnet or a material such as iron, nickel, cobalt, or an alloy thereof.

The magnetic body includes two first magnetic bodies 8*a* facing each other with an inner space of the slider 7 in between, and two second magnetic bodies 8*b* facing each other with the inner space of the slider 7 in between. The first magnetic bodies 8*a* and the second magnetic bodies 8*b* are arranged to be spaced apart from each other along a longitudinal direction of the main body 10, which is a moving direction of the slider 7, that is, the direction in which the main body 10 extends.

The main body 10 includes a fixed magnetic body 9 arranged on a path along which the first magnetic bodies 8*a* and the second magnetic bodies 8*b* of the slider 7 move while the slider 7 moves with respect to the main body 10. Two fixed magnetic bodies 9 of the main body 10 may be mounted to face each other with the accommodation space 19 in between.

Depending on the position of the slider 7, the slider 7 may be stably maintained in a position where an end of the mouthpiece 22 is covered or exposed by a magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move while the slider 7 moves with respect to the main body 10. The position change detecting sensor 3 may include, for example, a Hall integrated circuit (IC) that detects a change in a magnetic field according to the Hall effect and generates a signal.

In the aerosol generating device 5 according to the above-described embodiments, the main body 10, the cartridge 20, and the slider 7 have approximately rectangular cross-sectional shapes in a direction transverse to the longitudinal direction, but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly when extending in the longitudinal direction, and may extend a long way while being curved in a streamlined shape or bent at a preset angle in a specific area to be easily held by the user.

FIG. 2 is a perspective view of an exemplary operating state of the aerosol generating device according to the embodiment illustrated in FIG. 1.

In FIG. 2, the operating state is shown in which the slider 7 is moved to a position where the end of the mouthpiece 22 of the cartridge coupled to the main body 10 is covered. In a state where the slider 7 is moved to the position where the end of the mouthpiece 22 is covered, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

FIG. 3 is a perspective view of another exemplary operating state of the aerosol generating device according to the embodiment illustrated in FIG. 1.

In FIG. 3, the operating state is shown in which the slider 7 is moved to a position where the end of the mouthpiece 22 of the cartridge 20 coupled to the main body 10 is exposed to the outside. In a state where the slider 7 is moved to the position where the end of the mouthpiece 22 is exposed to the outside, the user may insert the mouthpiece 22 into his or her mouth and absorb aerosol discharged through the discharge hole 22*a* of the mouthpiece 22.

Even when the slider 7 is moved to the position where the end of the mouthpiece 22 is exposed to the outside, the protruding window 21*a* of the cartridge 20 is exposed to the outside through the elongated hole 7*a* of the slider 7, and thus, the user may visually check the remaining amount of aerosol generating material contained in the cartridge 20.

FIG. 4 is a block diagram illustrating hardware components of the aerosol generating device according to an embodiment.

Referring to FIG. 4, the aerosol generating device 400 may include a battery 410, a heater 420, a sensor 430, a user interface 440, a memory 450, and a controller 460. However, the internal structure of the aerosol generating device 400 is not limited to the structures illustrated in FIG. 4. According to the design of the aerosol generating device 400, it will be understood by one of ordinary skill in the art that some of the hardware components shown in FIG. 4 may be omitted or new components may be added.

In an embodiment, the aerosol generating device 400 may only include a main body without a cartridge, in which case hardware components included in the aerosol generating device 400 are located in the main body. In another embodiment, the aerosol generating device 400 may include a main body and a cartridge, in which case hardware components included in the aerosol generating device 400 are located separately in the main body and the cartridge. Alternatively, at least some of hardware components included in the aerosol generating device 400 may be located respectively in the main body and the cartridge.

Hereinafter, operation of each of the components will be described without being limited to their locations in the aerosol generating device 400.

The battery 410 supplies power to be used for the aerosol generating device 400 to operate. In other words, the battery 410 may supply power such that the heater 420 may be heated. In addition, the battery 410 may supply power required for operation of other hardware components included in the aerosol generating device 400, that is, the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 receives power from the battery 410 under the control of the controller 460. The heater 420 may receive power from the battery 410 and heat a cigarette inserted into the aerosol generating device 400, or heat the cartridge mounted on the aerosol generating device 400.

The heater 420 may be located in the main body of the aerosol generating device 400. Alternatively, when the aerosol generating device 400 consists of the main body and the cartridge, the heater 420 may be located in the cartridge. When the heater 420 is located in the cartridge, the heater 420 may receive power from the battery 410 located in at least one of the main body and the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto.

In an embodiment, the heater 420 may be a component included in the cartridge. The cartridge may include the heater 420, the liquid delivery element, and the liquid storage. The aerosol generating material accommodated in the liquid storage may be moved to the liquid delivery element, and the heater 420 may heat the aerosol generating material absorbed by the liquid delivery element, thereby generating aerosol. For example, the heater 420 may include a material such as nickel chromium and may be wound around or arranged adjacent to the liquid delivery element.

In another embodiment, the heater 420 may heat the cigarette inserted into the accommodation space of the aerosol generating device 400. As the cigarette is accommodated in the accommodation space of the aerosol generating device 400, the heater 420 may be located inside and/or outside the cigarette. Accordingly, the heater 420 may generate an aerosol by heating the aerosol generating material in the cigarette.

In addition, the heater 420 may include an induction heater. The heater 420 may include an electrically conductive coil for heating a cigarette or a cartridge by an induction heating method, and the cigarette or the cartridge may include a susceptor which may be heated by the induction heater.

The aerosol generating device 400 may include at least one sensor 430. A sensing result from the at least one sensor 430 is transmitted to the controller 460, and the controller 460 may control the aerosol generating device 400 to perform various functions such as controlling the operation of the heater, restricting smoking, determining whether a cigarette (or a cartridge) is inserted, and displaying a notification.

For example, the at least one sensor 430 may include a puff detecting sensor. The puff detecting sensor may detect a user's puff based on any one of a temperature change, a flow change, a voltage change, and a pressure change.

In addition, the at least one sensor 430 may include a temperature detecting sensor. The temperature detecting sensor may detect the temperature at which the heater 420 (or an aerosol generating material) is heated. The aerosol generating device 400 may include a separate temperature detecting sensor for sensing a temperature of the heater 420, or the heater 420 itself may serve as a temperature detecting sensor instead of including a separate temperature sensor. Alternatively, a separate temperature detecting sensor may be further included in the aerosol generating device 400 while the heater 420 serves as a temperature detecting sensor.

In addition, the at least one sensor 430 may include a position change detecting sensor. The position change detecting sensor may detect a change in a position of the slider coupled to the main body to move with respect to the main body.

The user interface 440 may provide the user with information about the state of the aerosol generating device 400. The user interface 440 may include various interfacing devices, such as a display or a light emitter for outputting visual information, a motor for outputting haptic information, a speaker for outputting sound information, input/output (I/O) interfacing devices (e.g., a button or a touch screen) for receiving information input from the user or outputting information to the user, terminals for performing data communication or receiving charging power, and communication interfacing modules for performing wireless communication (e.g., Wi-Fi, Wi-Fi direct, Bluetooth, near-field communication (NFC), etc.) with external devices.

However, the aerosol generating device 400 may be implemented by selecting only some of the above-described examples of various user interface 440.

The memory 450, as a hardware component configured to store various pieces of data processed in the aerosol generating device 400, may store data processed or to be processed by the controller 460. The memory 450 may include various types of memories; random access memory (RAM), such as dynamic random access memory (DRAM) and static random access memory (SRAM), etc.; read-only memory (ROM); electrically erasable programmable read-only memory (EEPROM), etc.

The memory 450 may store an operation time of the aerosol generating device 400, the maximum number of puffs, the current number of puffs, at least one temperature profile, data on a user's smoking pattern, etc.

The controller 460 may generally control operations of the aerosol generating device 400. The controller 460 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 460 analyzes a result of the sensing performed by at least one sensor 430, and controls the processes that are to be performed subsequently.

The controller 460 may control power supplied to the heater 420 so that the operation of the heater 420 is started or terminated, based on the result of the sensing performed by the at least one sensor 430. In addition, based on the sensing result from the at least one sensor 430, the controller 460 may control the amount of power supplied to the heater 420 and the time at which the power is supplied, so that the heater 420 is heated to a predetermined temperature or maintained at an appropriate temperature.

In an embodiment, the aerosol generating device 400 may include a plurality of modes. For example, the modes of the aerosol generating device 400 may include a preheating mode, an operation mode, an idle mode, and a sleep mode. However, the modes of the aerosol generating device 400 are not limited thereto.

In a state in which the aerosol generating device 400 is not used, the aerosol generating device 400 may maintain the sleep mode, and the controller 460 may control the output power of the battery 410 so that the power is not supplied to the heater 420 in the sleep mode. For example, before or after use of the aerosol generating device 400, the aerosol generating device 400 may operate in a sleep mode.

The controller 460 may set the mode of the aerosol generating device 400 to a preheating mode (or may convert to a preheating mode from the sleep mode), after the controller 460 receives a user input to the aerosol generating device 400 in order to start the operation of the heater 420.

In addition, the controller 460 may change the mode of the aerosol generating device 400 from the preheating mode to the heating mode after detecting the user's puff using the puff detecting sensor.

In addition, if the aerosol generating device 400 operates in the heating mode for longer than a preset time, the controller 460 may switch the mode of the aerosol generating device 400 from the heating mode to the idle mode.

In addition, the controller 460 may stop supplying power to the heater 420 when the number of puffs counted by the puff detecting sensor reaches the maximum number of puffs.

A temperature profile corresponding to each of the preheating mode, the heating mode, and the idle mode may be set. The controller 460 may control power supplied to the heater based on the power profile for each mode so that the aerosol generating material is heated according to the temperature profile for each mode.

The controller 460 may control the user interface 440 based on a result sensed by at least one sensor 430. For example, after counting the number of puffs using a puff detecting sensor, when the number of puffs reaches a preset number, the controller 460 may notify the user that an aerosol generating device 400 is about to be terminated, using at least one of a lamp, a motor, and a speaker.

Although not illustrated in FIG. 4, the aerosol generating device 400 may form an aerosol generating system together with an additional cradle. For example, the cradle may be used to charge the battery 410 of the aerosol generating device 400. For example, while the aerosol generating device 400 is accommodated in an accommodation space of the cradle, the aerosol generating device 400 may receive power from a battery of the cradle such that the battery 410 of the aerosol generating device 400 may be charged.

FIG. 5 is an exemplary view of a graph showing a change in a sensing value of a pressure sensor over time when a puff occurs, according to an embodiment.

An aerosol generating device includes a heater that heats an aerosol generating material, a battery that supplies power to the heater, and a controller that controls the overall operation of the aerosol generating device.

In addition, the aerosol generating device includes an airflow detecting sensor detecting a change in airflow inside the aerosol generating device, and a pressure sensor detecting a change in pressure outside the aerosol generating device.

The airflow detecting sensor may detect a change in airflow inside the aerosol generating device according to a puff. On the other hand, the pressure sensor may detect a change in pressure outside the aerosol generating device that is not related to a puff.

FIG. 5 shows graphs showing changes in sensing values of the airflow detecting sensor and the pressure sensor over time when a puff occurs in a situation where there is little change in pressure outside the aerosol generating device.

Referring to FIG. 5, a first graph 510 represents a sensing value over time by the airflow detecting sensor, and a second graph 520 represents a sensing value over time by the pressure sensor.

In an embodiment, the sensing values of the airflow detecting sensor and the pressure sensor may be set as a predetermined reference value 500 under a specific pressure and specific temperature condition.

Depending on specifications of the airflow detecting sensor and the pressure sensor, reference values of the airflow detecting sensor and the pressure sensor may be the same or different. In addition, a first threshold value for the airflow detecting sensor and a first threshold value for the pressure sensor may also be the same or different. Hereinafter, it is assumed that the reference value 500 and a first threshold value 501 of the airflow detecting sensor and the pressure sensor are the same.

The controller may determine whether a puff has occurred based on a first sensing value received from the airflow detecting sensor and a second sensing value received from the pressure sensor.

In an embodiment, when the first sensing value is maintained below the first threshold value for a predetermined length of time while the second sensing value is maintained above the first threshold value, the controller may determine that a puff has occurred.

The first threshold value for the airflow detecting sensor and the first threshold value for the pressure sensor may be the same or different. Hereinafter, it is assumed that the reference value 500 and a first threshold value 501 of the airflow detecting sensor and the pressure sensor are the same.

Referring to the first graph 510, the sensing value of the airflow detecting sensor is maintained at the reference value 500 before t0. Then, the sensing value of the airflow detecting sensor is in the range between the reference value 500 and the first threshold value 501 for a predetermined length of time (i.e., from t0 to t1), and falls below the first threshold value 501 after t1. The sensing value of the airflow detecting sensor is maintained below the first threshold value 501 for a predetermined length of time, that is, from t1 to t2.

Referring to the second graph 520, the sensing value of the pressure sensor is maintained above the first threshold value 501 from t1 to t2.

The first threshold value 501 may be a value at a level of about 50% to about 70% of the reference value 500, and the predetermined length of time (i.e., from t1 to t2) may be about 0.1 second to about 2.0 seconds, but embodiments are not limited thereto.

If the sensing value of the airflow detecting sensor is maintained below the first threshold value 501 from t1 to t2, and if the sensing value of the pressure sensor is maintained above the first threshold value 501 from t1 to t2, the controller may determine that a puff has occurred at t2 (i.e., when a predetermined length of time expires).

In an embodiment, after determining that a puff has occurred at t2, the controller may switch from a sleep mode or an idle mode to a preheating mode or a heating mode.

For example, when it is determined that a puff has occurred while the aerosol generating device is in a sleep mode, the controller may switch from a sleep mode to a preheating mode.

Alternatively, when it is determined that a puff has occurred while the aerosol generating device is in an idle mode, the controller may switch from an idle mode to a heating mode.

The aerosol generating device does not operate and power may not be supplied to the heater in the sleep mode. On the other hand, the aerosol generating device may supply power to the heater and generates an aerosol by heating an aerosol generating material. From the sleep mode, the aerosol generating device may switch to the preheating mode instead of directly entering the heating mode to raise the temperature of the heater to a certain temperature beforehand so that sufficient atomization occurs immediately in the heating mode. The aerosol generating device enters the idle mode if no puff is detected while power is supplied to the heater. In the idle mode, power supply to the heater may be stopped or the amount of power supplied to the heater may be reduced compared to the heating mode.

In an embodiment, the airflow detecting sensor may be a microphone. In addition, the pressure sensor may be an absolute pressure sensor. For example, the pressure sensor may be a microelectromechanical system (MEMS).

In an embodiment, the airflow detecting sensor may have a first reference value, and the pressure sensor may have a second reference value. When the first sensing value is maintained below the first threshold value for the first reference value for a predetermined length of time while the second sensing value is maintained above the first threshold value, it may be determined that a puff has occurred.

FIG. 6 is an exemplary view of a graph showing a change in a sensing value of a pressure sensor over time when a pressure outside an aerosol generating device changes, according to an embodiment.

Hereinafter, descriptions overlapping with those of FIG. 5 will not be given herein for convenience.

FIG. 6 shows graphs showing changes in sensing values of the airflow detecting sensor and the pressure sensor over time in a case where no puff has occurred but outside pressure suddenly changes.

Referring to FIG. 6, a first graph 610 represents a sensing value over time by the airflow detecting sensor, and a second graph 620 represents a sensing value over time by the pressure sensor. Hereinafter, it is assumed that the airflow detecting sensor and the pressure sensor have the same reference value 600.

The controller may determine whether a puff has occurred based on a first sensing value received from the airflow detecting sensor and a second sensing value received from the pressure sensor.

In an embodiment, when the first sensing value and the second sensing value are maintained below a first threshold value for a predetermined length of time, the controller may determine that no puff has occurred.

Referring to the first graph 610, the sensing value of the airflow detecting sensor is maintained at the reference value 600 before t0. From t0 to t1, the sensing value of the airflow detecting sensor is in the range between the reference value 600 and a first threshold value 601. Then, the sensing value of the airflow detecting sensor falls below the first threshold value 601 and is maintained below the first threshold value 601 for a predetermined length of time, that is, from t1 to t2.

Referring to the second graph 620, the sensing value of the pressure sensor is maintained below the first threshold value 601 for the predetermined period (i.e., from t1 to t2).

The first threshold value 601 may be a value at a level of about 50% to about 70% of the reference value 600, and the predetermined length of time (i.e., from t1 to t2) may be about 0.1 second and about 2.0 seconds, but embodiments are not limited thereto.

After determining that no puff has occurred at t2, the controller may maintain the operation mode of the aerosol generating device. For example, if the aerosol generating device has been in a sleep mode (or idle mode) before t2, the sleep mode (or idle mode) is maintained after t2.

In the present disclosure, by determining whether a puff has occurred using the airflow detecting sensor and the pressure sensor, it is possible to prevent falsely determining that a puff has occurred when the pressure outside the aerosol generating device has rapidly changed.

For example, when a user boards an elevator while carrying an aerosol generating device, atmospheric pressure outside the aerosol generating device may change rapidly as the elevator rises or falls. As another example, when a user boards a vehicle while carrying an aerosol generating device, atmospheric pressure outside the aerosol generating device may change rapidly due to a change in acceleration of the vehicle.

Referring to FIGS. 5 and 6, the first sensing value of the airflow detecting sensor is maintained below the first threshold value for a predetermined length of time in a case where a puff actually occurs as well as in a case where there is no puff but pressure outside the aerosol generating device changes rapidly. Therefore, the two cases cannot be distinguished if the airflow detecting sensor is only used to detect a puff.

In this case, when a puff has not occurred but the pressure outside the aerosol generating device changes rapidly as shown in FIG. 6, the controller may incorrectly determine that the puff has actually occurred and power may be unnecessarily supplied to the heater.

On the other hand, in the present disclosure, by using the pressure sensor as well as the airflow detecting sensor to determine whether a puff has occurred, it is possible to distinguish a case where a puff actually occurs and a case where the pressure outside the aerosol generating device changes rapidly.

As a result, according to embodiments, when an actual puff has not occurred but the pressure outside an aerosol generating device changes rapidly, power is prevented from being supplied to a heater, thereby preventing energy loss and reducing a fire risk.

In an embodiment, the airflow detecting sensor may be a microphone. In addition, the pressure sensor may be an absolute pressure sensor. For example, the pressure sensor may be an MEMS.

In an embodiment, the airflow detecting sensor may have a first reference value, and the pressure sensor may have a second reference value. When the first sensing value is maintained below the first threshold value associated with the first reference value for a predetermined length of time while the second sensing value is maintained below the first threshold value for the second reference value, it may be determined that no puff has occurred.

FIG. 7 is an exemplary view of a graph showing a change in a sensing value of a pressure sensor over time when a puff occurs in a situation in which a pressure outside an aerosol generating device changes, according to an embodiment.

Hereinafter, descriptions overlapping with those of FIG. 5 will not be given herein for convenience.

FIG. 7 shows graphs showing changes in sensing values of the airflow detecting sensor and the pressure sensor over time when a puff occurs in a situation where the pressure outside the aerosol generating device changes.

Referring to FIG. 7, a first graph 710 represents a sensing value over time by the airflow detecting sensor, and a second graph 720 represents a sensing value over time by the pressure sensor. Hereinafter, it is assumed that the airflow detecting sensor and the pressure sensor have the same reference value 700.

The controller may determine whether a puff has occurred based on a first sensing value received from the airflow detecting sensor and a second sensing value received from the pressure sensor.

In an embodiment, as long as the first sensing value is maintained below a second threshold value for a predetermined length of time, the controller may determine that a puff has occurred even if the second sensing value is maintained below a first threshold value for the same period. The second threshold value is less than the first threshold value.

Referring to the first graph 710, the sensing value of the airflow detecting sensor is maintained at the reference value 700 before t0. Then, the sensing value of the airflow detecting sensor is in the range between the reference value 700 and a second threshold value 702 from t0 to t1, and falls below a second threshold value 702 after t1. The sensing value of the airflow detecting sensor is maintained below the second threshold value 702 for a predetermined length of time, that is, from t1 to t2.

Referring to the second graph 720, the sensing value of the pressure sensor is maintained below the first threshold value 701 during a time period corresponding to the predetermined length of time (i.e., from t1 to t2).

The first threshold value 701 may be a value at a level of about 50% to about 70% of the reference value 700, and the predetermined time period (i.e., from t1 to t2) may be about 0.1 second and about 2.0 seconds. In addition, the second threshold value 702 may be a value at a level of about 30% to about 50% of the reference value 700. However, embodiments are not limited thereto.

In an embodiment, after determining that a puff has occurred at t2, the controller may switch from a sleep mode to a preheating mode, or from an idle mode to a heating mode.

For example, when it is determined that a puff has occurred while the aerosol generating device is in a sleep mode, the controller may switch from a sleep mode to a preheating mode.

Alternatively, when it is determined that a puff has occurred while the aerosol generating device is in an idle mode, the controller may switch from an idle mode to a heating mode.

In the present disclosure, by determining whether a puff has occurred using the airflow detecting sensor and the pressure sensor, it is possible to accurately determine whether a puff has occurred even when the pressure outside an aerosol generating device changes.

For example, when a user boards a vehicle while carrying an aerosol generating device, atmospheric pressure outside the aerosol generating device may change rapidly due to a change in acceleration of the vehicle. In the present disclosure, by using not only the first threshold value but also the second threshold value, it is possible to accurately determine whether a puff has occurred even when atmospheric pressure outside the aerosol generating device changes rapidly.

That is, according to embodiments, it is possible to more precisely control the aerosol generating device by accurately detect a puff regardless of the atmospheric pressure outside the aerosol generating device.

In an embodiment, the airflow detecting sensor may have a first reference value, and the pressure sensor may have a second reference value. If a sensing value of the airflow detecting sensor is maintained below the second threshold value associated with the first reference value for a predetermined length of time, it may be determined that a puff has occurred even if a sensing value of the pressure sensor is maintained below the first threshold value associated with the second reference value for the same period. The second threshold value is less than the first threshold value.

FIG. 8 is a cross-sectional view of an aerosol generating device including a plurality of pressure sensors, according to an embodiment.

Referring to FIG. 8, an aerosol generating device 800 may include a heater 830. Internal and external structures of the aerosol generating device 800 are not limited to those shown in FIG. 8. It will be understood by one of ordinary skill in the art that another hardware component may be further added according to the design of the aerosol generating device 800.

The aerosol generating device 800 may include an inlet 812 through which air is introduced from the outside and an outlet 813 through which the introduced air is discharged to the outside. In addition, an airflow path 811 may be located between the inlet 812 and the outlet 813.

When a user puffs, the air introduced through the inlet 812 may move along the airflow path 811 inside the aerosol generating device 800 to reach the heater 830. The air reaching the heater 830 may be discharged to the outside through the outlet 813 by transporting an aerosol generated by heating of the heater 830, and the aerosol discharged to the outside may be delivered to the user.

An airflow detecting sensor 810 may be in fluid communication with the airflow path 811. When a user puffs, air moves through the airflow path 811 located between the inlet 812 and the outlet 813. Accordingly, the airflow detecting sensor 810 in fluid communication with the airflow path 811 may detect a change in pressure in the airflow path 811 (that is, a change in airflow inside the aerosol generating device 800).

A pressure sensor 820 may be in fluid communication with the outside of the aerosol generating device 800 such that it may detect a pressure change outside the aerosol generating device 800. In addition, the pressure sensor 820 may be located in a space independent of the airflow path 811 such that the pressure sensor 820 is not in fluid communication with the airflow path 811. Accordingly, a sensing value of the pressure sensor 820 may not be affected by a user's puff.

In an embodiment, the airflow detecting sensor 810 is a sensor suitable for detecting airflow, and may be a microphone.

Further, the pressure sensor 820 is a pressure sensor suitable for detecting a change in atmospheric pressure, and may be an absolute pressure sensor. For example, the pressure sensor 820 may be an MEMS.

FIG. 9 is a flowchart illustrating a method of controlling an aerosol generating device according to an embodiment.

Referring to FIG. 9, in operation 910, a controller may receive a first sensing value from an airflow detecting sensor that detects a change in airflow inside the aerosol generating device.

The aerosol generating device may include an inlet through which air is introduced from the outside and an outlet through which the introduced air is discharged to the outside. In addition, an airflow path may be located between the inlet and the outlet.

The airflow detecting sensor may be in fluid communication with the airflow path. When a user puffs, air moves through the airflow path located between the inlet and outlet. Because the airflow detecting sensor is in fluid communication with the airflow path, when a puff occurs, the airflow detecting sensor may detect a change in airflow inside the aerosol generating device.

In an embodiment, the airflow detecting sensor is a pressure sensor suitable for detecting airflow, and may be a microphone.

In operation 920, the controller may receive a second sensing value from a pressure sensor that detects a pressure change outside the aerosol generating device.

The pressure sensor may be in fluid communication with the outside of the aerosol generating device to detect a pressure change outside the aerosol generating device. In addition, the pressure sensor may be located in a space independent of the airflow path.

That is, because the pressure sensor is not in fluid communication with the airflow path, a sensing value of the pressure sensor may not change even when a puff occurs.

In an embodiment, the pressure sensor is a pressure sensor suitable for detecting a change in atmospheric pressure, and may be an absolute pressure sensor. For example, the pressure sensor may be an MEMS.

In operation 930, the controller may determine whether a puff has occurred based on the first sensing value and the second sensing value.

In an embodiment, when the first sensing value is maintained below the first threshold value for a predetermined time period and the second sensing value is maintained above the first threshold value for a predetermined time period, the controller may determine that a puff has occurred.

After determining that a puff has occurred, the controller may switch from a sleep mode (or an idle mode) to a preheating mode (or a heating mode).

For example, when it is determined that a puff has occurred while the aerosol generating device is in a sleep mode, the controller may switch the mode of the aerosol generating device from a sleep mode to a preheating mode. Also, when it is determined that a puff has occurred while the aerosol generating device is in an idle mode, the controller may switch the mode of the aerosol generating device from an idle mode to a heating mode. However, embodiments are not limited thereto. For example, when a puff is detected, the aerosol generating device may switch from the sleep mode directly to the heating mode.

In an embodiment, when the first sensing value and the second sensing value are maintained below a first threshold value for a predetermined length of time, the controller may determine that no puff has occurred.

After determining that no puff has occurred, the controller may maintain the mode of the aerosol generating device as before. For example, when the mode of the aerosol generating device is a sleep mode (or an idle mode), the mode of the aerosol generating device may be maintained as a sleep mode (or an idle mode) after it is determined that no puff has occurred.

In the present disclosure, by using the pressure sensor as well as the airflow detecting sensor to determine whether a puff has occurred, it is possible to distinguish a case where a puff actually occurs and a case where the pressure outside the aerosol generating device changes rapidly while there is no puff.

In the present disclosure, by determining whether a puff has occurred using the airflow detecting sensor and the pressure sensor, it is possible to prevent an aerosol generating device from falsely detecting a puff due to a change in outside pressure.

In an embodiment, when a sensing value of the airflow detecting sensor is maintained below the second threshold value for a predetermined length of time, the controller may determine that a puff has occurred even if a sensing value of the pressure sensor is maintained below the first threshold value for the same period. The second threshold value is less than the first threshold value.

After determining that a puff has occurred, the controller may switch from a sleep mode or an idle mode to a preheating mode or a heating mode.

For example, when it is determined that a puff has occurred while the aerosol generating device is in a sleep mode, the controller may switch from a sleep mode to a preheating mode. Also, when it is determined that a puff has occurred while the aerosol generating device is in an idle mode, the controller may switch from an idle mode to a heating mode.

In the present disclosure, by determining whether a puff has occurred using the airflow detecting sensor and the pressure sensor, it is possible to accurately determine whether a puff has occurred even when the pressure outside an aerosol generating device changes.

In the present disclosure, it is possible to more precisely control the aerosol generating device by accurately detecting a puff regardless of the atmospheric pressure outside the aerosol generating device.

At least one of the components, elements, modules or units (collectively "components" in this paragraph) represented by a block in the drawings, such as the controller 460, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

One embodiment may also be implemented in the form of a computer-readable medium including instructions executable by a computer, such as a program module executable by the computer. The computer-readable medium may be any available medium that can be accessed by a computer and includes both volatile and nonvolatile media, and removable and non-removable media. In addition, the non-transitory computer readable medium may include all computer storing media and communication media. The computer storing medium may include any medium, such as, a volatile and non-volatile medium and a discrete type and non-discrete type medium that is realized by a method or technology for storing information, such as, a computer readable instruction, a data structure, a program module, or other data. The communication medium typically includes computer-readable instructions, data structures, other data in modulated data signals such as program modules, or other transmission mechanisms, and includes any information transfer media.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating device comprising:

a heater configured to heat an aerosol generating material;

a battery configured to supply power to the heater;

an airflow detecting sensor configured to detect a change in airflow inside the aerosol generating device;

a pressure sensor configured to detect a change in pressure outside the aerosol generating device; and a controller configured to:

control power supplied to the heater according to a preheating mode, receive a first sensing value from the airflow detecting sensor and a second sensing value from the pressure sensor, detect a puff based on the first sensing value and the second sensing value, determine that the puff has occurred if the first sensing value is maintained below a first threshold value for a predetermined length of time while the second sensing value is maintained above the first threshold value, determine that no puff has occurred if the first sensing value is maintained below the first threshold value and above a second threshold value for the predetermined length of time while the second sensing value is maintained below the first threshold value, determine that the puff has occurred if the first sensing value is maintained below the second threshold value for the predetermined length of time while the second sensing value is maintained below the first threshold value, and in a state in which power is being supplied to the heater according to the preheating mode, based on determining that the puff has occurred, control power supplied to the heater according to a heating mode, wherein the second threshold value is less than the first threshold value, wherein the predetermined length of time is a length of time to determine whether or not the puff occurs, and wherein, among the preheating mode and the heating mode, atomization is only generated in the heating mode.

2. The aerosol generating device of claim 1, further comprising:

an airflow path located between an inlet through which air is introduced from outside of the aerosol generating device and an outlet through which the introduced air is discharged to the outside, wherein the airflow detecting sensor is in fluid communication with the airflow path.

3. The aerosol generating device of claim 2, wherein the pressure sensor is located in a space independent of the airflow path, and is in fluid communication with outside of the aerosol generating device.

4. The aerosol generating device of claim 1, wherein the controller is configured to switch from a sleep mode to the preheating mode or from an idle mode to the heating mode, based on the puff being detected.

5. The aerosol generating device of claim 1, wherein the airflow detecting sensor is a microphone, and the pressure sensor is an absolute pressure sensor.

6. The aerosol generating device of claim 1, wherein the controller is configured to:

determine that the puff has occurred if the first sensing value is maintained below the first threshold value and above the second threshold value for the predetermined length of time while the second sensing value is maintained above the first threshold value, and determine that the puff has occurred if the first sensing value is maintained below the second threshold value for the predetermined length of time while the second sensing value is maintained below the first threshold value and above the second threshold value.

* * * * *